US010151997B2

(12) United States Patent
Suzuki

(10) Patent No.: US 10,151,997 B2
(45) Date of Patent: Dec. 11, 2018

(54) IMAGE FORMING APPARATUS

(71) Applicant: CANON KABUSHIKI KAISHA, Tokyo (JP)

(72) Inventor: Hideaki Suzuki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/363,488

(22) Filed: Nov. 29, 2016

(65) Prior Publication Data

US 2017/0168414 A1 Jun. 15, 2017

(30) Foreign Application Priority Data

Dec. 10, 2015 (JP) ..... 2015-240858

(51) Int. Cl.

*G03G 15/06* (2006.01)
*G03G 15/01* (2006.01)
*G03G 15/02* (2006.01)

(52) U.S. Cl.

CPC ..... *G03G 15/065* (2013.01); *G03G 15/0121* (2013.01); *G03G 15/0266* (2013.01); *G03G 15/0189* (2013.01)

(58) Field of Classification Search

CPC ..... G03G 15/065; G03G 15/0121; G03G 15/0266; G03G 15/0189

See application file for complete search history.

(56) References Cited

U.S. PATENT DOCUMENTS 8,768,184 B2 7/2014 Ishida
2014/0044446 A1* 2/2014 Tsukada ..... G03G 15/0848 399/55

FOREIGN PATENT DOCUMENTS

JP 09-34243 A 2/1997
JP 2002-148888 A 5/2002
JP 2012-128320 A 7/2012

* cited by examiner

*Primary Examiner* — David M Gray
*Assistant Examiner* — Andrew V Do
(74) *Attorney, Agent, or Firm* — Venable, LLP

(57) ABSTRACT

An image forming apparatus includes first and second image forming units each having an image bearing member and an electrification portion. A developing bias application portion applies a common developing bias to first and second developer bearing members. A controller controls a second electrification bias application portion so as to have a voltage value of a second electrification bias applied to a second electrification portion in a first period different from that in a second period such that an absolute value of a potential difference between a surface potential of a second image bearing member and the common developing bias applied to the second developer bearing member in the first period is smaller than that in the second period.

12 Claims, 14 Drawing Sheets

Prior Art

Prior Art

IMAGE FORMING APPARATUS

BACKGROUND OF THE INVENTION

Field of the Invention

The present invention relates to an image forming apparatus, for example, a printer, a copier, a facsimile machine, or a multifunctional apparatus, that utilizes an electrophotographic technique.

Description of the Related Art

In an image forming apparatus that utilizes an electrophotographic technique, a two-component developer including a toner and a carrier is used, and, in the case where a developing sleeve serving as a developer bearing member is rotated for a long time unnecessarily, the toner is likely to deteriorate. The toner that has deteriorated may cause an image defect. Therefore, Japanese Unexamined Patent Application Publication No. 9-34243 discloses an apparatus that refreshes toner by adding new toner while forcibly discharging the toner that has deteriorated.

However, it is better to perform the refreshing of toner described above as less frequently as possible because some toner is consumed in the refreshing of toner. Thus, it is better to suppress the deterioration of the toner. The deterioration of the toner may be suppressed by making the time during which the developing sleeve rotates unnecessarily as short as possible. Therefore, Japanese Unexamined Patent Application Publication No. 2012-128320 proposes an apparatus configured to stop the developing sleeve as long as possible, for example, in a sheet interval.

However, in the case where a fog-removing potential difference is present between a photosensitive drum and the developing sleeve when the developing sleeve serving as the developer bearing member is stopped, the fog-removing potential difference is only applied to a part of the developing sleeve opposing the photosensitive drum. In this case, the toner in the developer is likely to attach to the surface of the part of the developing sleeve in a line shape. This attachment of toner to the developing sleeve may cause a belt-shaped image defect called as a stripe image in the subsequent image formation. Thus, the apparatus disclosed in Japanese Unexamined Patent Application Publication No. 2012-128320 stops the developing sleeve after controlling a developing voltage such that the fog-removing potential difference in the sheet interval is smaller than in image formation. The fog-removing potential difference will be also simply described as Vback.

In addition, an image forming apparatus, for example, of a type sharing a developing power source that simultaneously applies a developing voltage from a common developing power source to image forming units of respective colors of yellow, magenta, cyan, and so forth arranged in order in a movement direction of a recording material or an intermediate transfer belt that is used for reducing the cost is known nowadays.

In the case of the image forming apparatus of the type sharing a developing power source, the developing sleeve of the image forming unit of each color is configured to be individually controllable, and is rotated unnecessarily as less frequently as possible in order to suppress the deterioration of toner. At the start of image formation, the rotation of the developing sleeve is started from the image forming unit of yellow, followed by other image forming units in order, and, at the end of the image formation, the rotation of the developing sleeve of the image forming unit of yellow is stopped first, also followed by other image forming units. In this case, the developing voltage starts being applied in the image forming unit for yellow at the start of the image formation, and thus the developing voltage may be applied in the image forming units for magenta and cyan before respective developing sleeves starts rotating, i.e. when the developing sleeves are stopped. Meanwhile, the application of developing voltage is stopped when the image formation by the image forming unit for cyan is finished. This means that the developing voltage remains being applied to the image forming units for yellow and magenta even after the developing sleeves thereof are stopped. That is, in an image forming apparatus of the type sharing a developing power source, toner has been likely to attach to the developing sleeve because the fog-removing potential difference is applied also at the start and end of the image formation even though the developing sleeve is stopped.

SUMMARY OF THE INVENTION

The present invention provides an image forming apparatus capable of reducing attachment of toner to a developing sleeve that occurs when the rotation of the developing sleeve is stopped in the case of forming an image by using a plurality of developing units that share a power source.

According to an aspect of the present invention, a first image forming unit, a second image forming unit, a transfer unit, a voltage application unit, and a control unit is provided. The first image forming unit includes a first image bearing member, a first electrification unit, a first developer bearing member, and a first driving unit. The first image bearing member is rotatable. The first electrification unit is configured to electrify a surface of the first image bearing member. The first developer bearing member is configured to develop a first electrostatic latent image formed on the first image bearing member with a first toner by rotating while bearing a first developer including the first toner and a first carrier and being subjected to a first developing voltage. The first driving unit is configured to drive the first developer bearing member to rotate. The second image forming unit includes a second image bearing member, a second electrification unit, a second developer bearing member, and a second driving unit. The second image bearing member is rotatable. The second electrification unit is configured to electrify a surface of the second image bearing member. The second developer bearing member is configured to develop a second electrostatic latent image formed on the second image bearing member with a second toner by rotating while bearing a second developer including the second toner and a second carrier and being subjected to a second developing voltage. The second driving unit is configured to drive the second developer bearing member to rotate. The transfer unit is configured to form, on a moving transfer member, an image formed by the first image forming unit and an image formed by the second image forming unit. The first image forming unit is disposed upstream of the second image forming unit in a direction of movement of the transfer member. The voltage application unit is configured to apply a common voltage to the first developer bearing member and the second developer bearing member. The control unit is configured to control, in starting image formation by using the first image forming unit and the second image forming unit from a state where the first developer bearing member and the second developer bearing member are stopped, a potential difference of the second image forming unit between a surface potential of the second image bearing member and a voltage applied to the second developer bearing member such that the potential difference in a case where the common voltage is applied by the voltage application unit and the second developer bearing member is not rotating is smaller than the potential difference in a case where the common voltage is applied by the voltage application unit and the second developer bearing member is rotating.

Further features of the present invention will become apparent from the following description of exemplary embodiments with reference to the attached drawings.

DESCRIPTION OF THE EMBODIMENTS

An exemplary embodiment of the present invention will be described with reference to FIGS. 1 to 10. First, an overall configuration of an image forming apparatus will be described with reference to FIGS. 1 to 4.

Image Forming Apparatus

An image forming apparatus 100 according to the present exemplary embodiment is a color laser printer utilizing a transfer method of electrophotographic process, a contact electrification method, and a reversal development system. The image forming apparatus 100 outputs a color image by forming the color image on a recording material, for example, a sheet material such as a paper sheet or an OHP sheet, on the basis of image information received from an external host apparatus such as a personal computer or an image reading apparatus that is communicatively connected to the apparatus body of the image forming apparatus 100.

Figure 1:
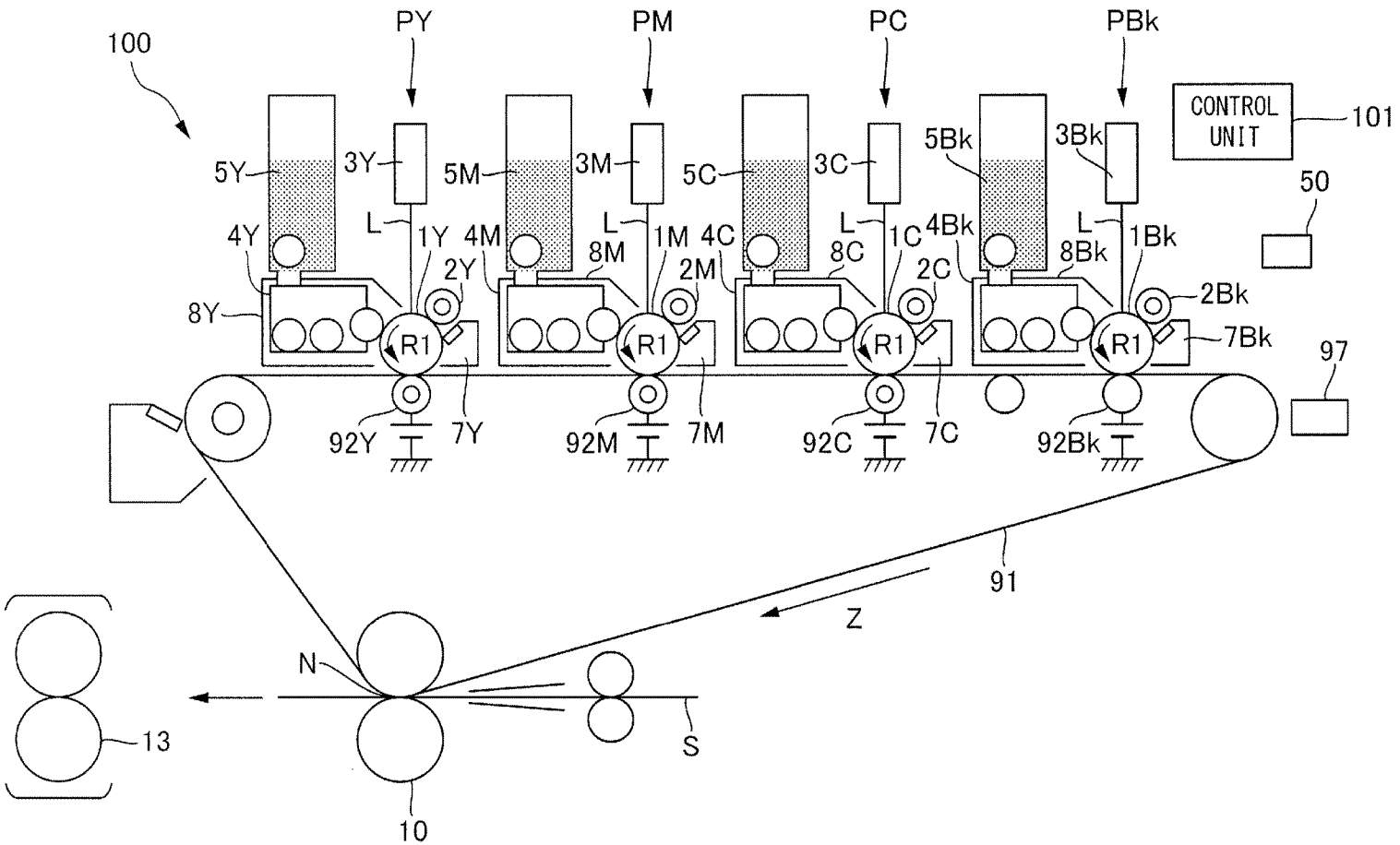
FIG. 1 illustrates an overall configuration of an image forming apparatus.

As illustrated in FIG. 1, the image forming apparatus 100 is a so-called tandem-type image forming apparatus in which a plurality of image forming units are arranged in a movement direction of an intermediate transfer belt 91 serving as an intermediate transfer member. That is, the image forming apparatus 100 includes a plurality of process cartridges 8Y to 8Bk, and temporarily and consecutively transfers toner images onto the intermediate transfer belt 91, which is movable in a predetermined direction, such that the toner images are superimposed on one another by using the process cartridges 8Y to 8Bk. Then, the toner images are collectively transferred from the intermediate transfer belt 91 onto a recording material S to form a color image. In the present exemplary embodiment, the four process cartridges 8Y to 8Bk respectively corresponding to yellow, magenta, cyan, and black are arranged in series and in this order from upstream to downstream in the movement direction of the intermediate transfer belt 91, i.e. a Z direction in FIG. 1.

The image forming apparatus 100 includes image forming units PY, PM, PC, and PBk that are respectively used for forming images of yellow, magenta, cyan, and black. The letters Y, M, C, and Bk respectively correspond to yellow, magenta, cyan and black. The four image forming units PY, PM, PC, and PBk are configured in approximately the same way as each other except that toner of a different color is used for each of developing units 4Y, 4M, 4C, and 4Bk. Yellow, magenta, cyan, and black toners are respectively used for the developing units 4Y, 4M, 4C, and 4Bk. Therefore, the additional letters Y, M, C, and Bk indicating different colors will be omitted in the following description in the case where elements for different colors do not need to be distinguished from each other.

An overall operation of forming a four-color image will be described as an example. In the operation, image signals decomposed into different colors are generated in accordance with a signal received from the external host apparatus communicatively connected to the image forming apparatus 100. In accordance with these image signals, toner images of respective colors are formed by the process cartridges 8Y, 8M, 8C, and 8Bk of the image forming units PY, PM, PC, and PBk respectively serving as first to fourth image forming units.

The process cartridges 8Y, 8M, 8C, and 8Bk each include a drum-shaped electrophotographic photoreceptor including a photosensitive layer of an organic substance on a conductive support body, that is, a photosensitive drum 1. The surface of the photosensitive drum 1 serving as an image bearing member is electrified to an electrification potential by a predetermined electrification voltage applied to an electrification roller 2 serving as an electrification unit. The uniformly electrified surface is scanned and exposed to light by an exposing unit 3, which is a laser beam scanner, and an electrostatic latent image is thereby formed on the photosensitive drum 1. Toner serving as a developer is supplied to this electrostatic latent image by a developing unit 4, and a toner image is thereby formed on the photosensitive drum 1.

Figure 2:
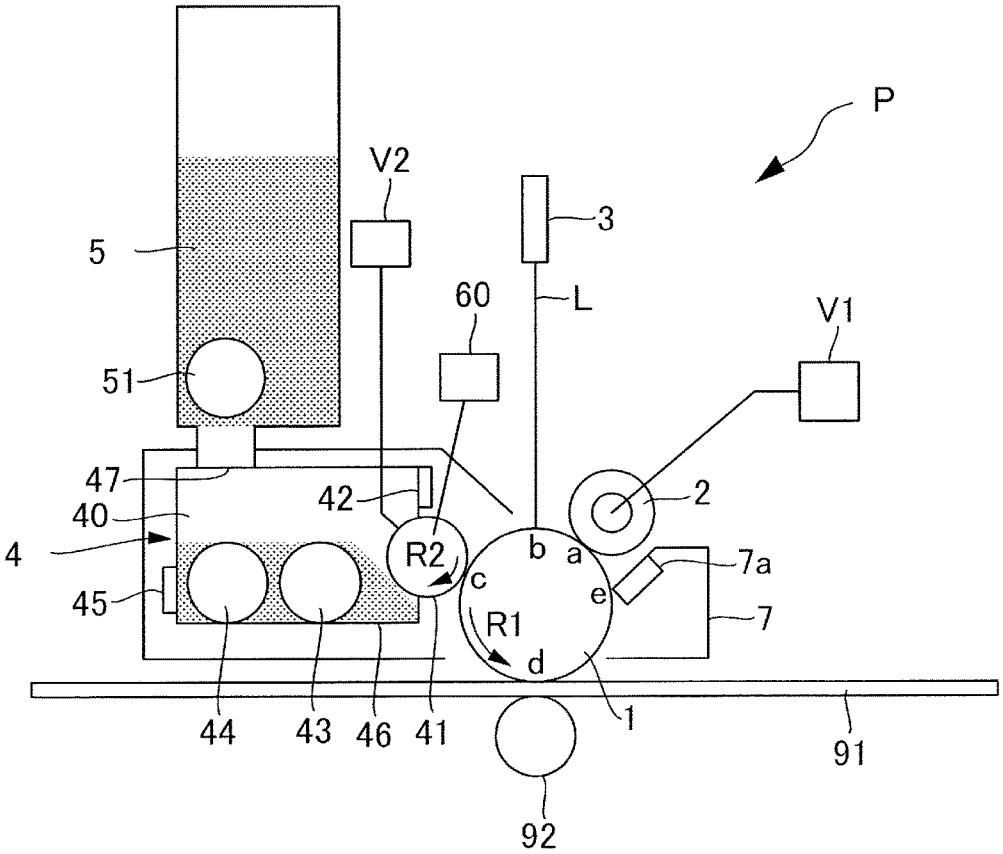
FIG. 2 is a section view of a developing unit illustrating a configuration thereof.

The toner images of respective colors formed on photosensitive drums 1 are sequentially transferred through primary transfer onto the intermediate transfer belt 91 having an endless-belt shape so as to be superimposed on one another at primary transfer portions d illustrated in FIG. 2. Primary transfer rollers 92 are provided on the inner circumference side of the intermediate transfer belt 91 serving as an image bearing member so as to oppose the respective photosensitive drums 1. The primary transfer of the toner images from the photosensitive drums 1 onto the intermediate transfer belt 91 is performed due to the effect of the primary transfer rollers 92. A color toner image formed on the intermediate transfer belt 91 is collectively transferred through secondary transfer onto the recording material S conveyed to a secondary transfer portion N at which the intermediate transfer belt 91 and a secondary transfer roller 10 oppose each other. Subsequently, the recording material onto which the toner image has been transferred is conveyed to a fixing unit 13 and is discharged to the outside of the apparatus after being subjected to fixing of the toner image at the fixing unit 13. In the present exemplary embodiment, the fixing unit 13 melts the toner image and fixes the toner image to the recording material S by applying heat and pressure to the recording material S by using a fixing roller pair.

Image Forming Unit

Next, each element of the image forming unit P will be described in more detail with reference to FIG. 2. As illustrated in FIG. 2, in the image forming unit P, the electrification roller 2, the exposing unit 3, the developing unit 4, the primary transfer roller 92, and a cleaning device 7 are disposed around the photosensitive drum 1. Each image forming unit P includes these components. That is, the image forming units P respectively include the photosensitive drums 1 serving as the first to fourth image bearing member, the electrification rollers 2 serving as first to fourth electrification units, the exposing units 3 serving as first to fourth exposing units, and the developing units 4 serving as first to fourth developing units.

In the present exemplary embodiment, the photosensitive drum 1 is an organic photoconductive drum, i.e. an OPC drum, and the outer diameter thereof is 30 mm. In addition, the photosensitive drum 1 is driven to rotate about a central support shaft in an arrow R1 direction in FIG. 2, i.e. a counterclockwise direction, at a process speed, i.e. a circumferential speed, of 240 mm/sec.

The electrification roller 2 is an electrification member formed in a roller shape. By applying an electrification voltage of predetermined conditions to the electrification roller 2 serving as an electrification unit, the photosensitive drum 1 is uniformly electrified to an electrification potential having a negative polarity. In the present exemplary embodiment, the electrification roller 2 is 320 mm long in the longitudinal direction, i.e. the direction of rotation shaft, and is configured by applying a surface layer on a base layer around a core metal serving as a supporting member. In further detail, the electrification roller 2 is configured by using a stainless metal shaft having a diameter of 6 mm as the core metal and using a carbon-dispersed fluorine resin for the surface layer. The electrification roller 2 has an outer diameter of 14 mm and an electrical resistivity of $10^4$ to $10^7\Omega$. Each end portion of the core metal of the electrification roller 2 is rotatably supported by a bearing member, and the electrification roller 2 is urged toward the photosensitive drum 1 by a pressurizing spring and is pressed against the surface of the photosensitive drum 1 with a predetermined pressing force. The electrification roller 2 is rotated by the rotation of the photosensitive drum 1.

A direct current voltage is applied from an electrification power source V1 serving as an electrification voltage application unit to the electrification roller 2 via the core metal. This electrifies the circumferential surface of the rotating photosensitive drum 1 to a predetermined surface potential, i.e. an electrification potential. An electrification position a is a contact portion between the electrification roller 2 and the photosensitive drum 1. In the present exemplary embodiment, the voltage, i.e. an electrification bias, applied to the electrification roller 2 in image formation is a direct current voltage of −1000 V. As a result of being in contact with the electrification roller 2, the circumferential surface of the photosensitive drum 1 is uniformly electrified to −750 V serving as the electrification potential and a dark potential by the direct current electrification voltage.

The photosensitive drum 1 is subjected to image exposure with laser light L by the exposing unit 3 after being uniformly electrified to a predetermined potential and polarity by the electrification roller 2. In the present exemplary embodiment, the exposing unit 3 includes, for example, a color separation/imaging exposure optical system for a color original image and a scanning exposure system that performs laser scanning using a laser beam modulated in accordance with a time-series electrical digital pixel signal of image information. Electrostatic latent images of respective color components of a target color image corresponding to the image forming units PY, PM, PC, and PBk are formed on the photosensitive drums 1Y, 1M, 1C, and 1Bk by the exposing unit 3 as illustrated in FIG. 1. The exposing unit 3 is provided downstream of the electrification roller 2 in the rotation direction of the photosensitive drum 1.

In the present exemplary embodiment, a laser beam scanner utilizing a semiconductor laser is used as the exposing unit 3. The laser beam scanner outputs laser light modulated in accordance with an image signal transmitted from the external host apparatus to the image forming apparatus 100, and exposes, i.e. subjects to image exposure, a uniform electrification treatment surface of the rotating photosensitive drum 1 by scanning the uniform electrification treatment surface. By this laser-scanning exposure, the potential of a portion of the photosensitive drum 1 irradiated with the laser light L decreases, and the electrostatic latent image corresponding to the image information used for the scanning exposure is formed on the rotating photosensitive drum 1. In the present exemplary embodiment, the potential of the exposed part is −390 V. An exposure position b is the position on the photosensitive drum 1 irradiated with the laser light L in the image exposure.

The electrostatic latent image formed on the photosensitive drum 1 is developed with toner by the developing unit 4. In the present exemplary embodiment, the developing unit 4 is a two-component contact developing unit, i.e. a two-component magnetic brush developing unit. The developing unit 4 includes a developer container 40, a developing sleeve 41, a regulating blade 42, screws 43 and 44, and so forth. The developing sleeve 41 serves as the developer bearing member and a magnet roller is fixed in a space enclosed by the developing sleeve 41. The screws 43 and 44 are provided in a bottom portion of the developer container 40 and serve as developer agitating members. In the developer container 40, mainly a two-component developer 46 is accommodated. The two-component developer 46 is a mixture of resin toner particles and magnetic carrier particles.

A part of the outer circumferential surface of the developing sleeve 41 is exposed to the outside of the developer container 40, and the developing sleeve 41 is provided so as to be rotatable in the developer container 40. The developing sleeve 41 rotates while bearing the developer agitated and conveyed by the screws 43 and 44. The toner and the carrier in the developer 46 are respectively electrified to a negative polarity and a positive polarity by being agitated by the screws 43 and 44.

The restriction blade 42 opposes the developing sleeve 41 with a predetermined gap there between, and forms a thin developer layer on the developing sleeve 41 in accordance with the rotation of the developing sleeve 41 in an arrow R2 direction, i.e. a clockwise direction, illustrated in FIG. 2. In the present exemplary embodiment, the developing sleeve 41 is provided in the vicinity of the photosensitive drum 1 so as to oppose the photosensitive drum 1 while keeping the distance between the photosensitive drum 1 and the portion of the developing sleeve 41 closest to the photosensitive drum 1, i.e. an SD gap, to 310 μm. A developing position c is a position at which the photosensitive drum 1 and the developing sleeve 41 oppose each other. The developing sleeve 41 is rotated by a motor 60 serving as a driving unit such that the surface of the developing sleeve 41 moves in the same direction as the movement direction of the surface of the photosensitive drum 1, i.e. the arrow R1 direction in FIG. 2, at the developing position c.

Figure 3:
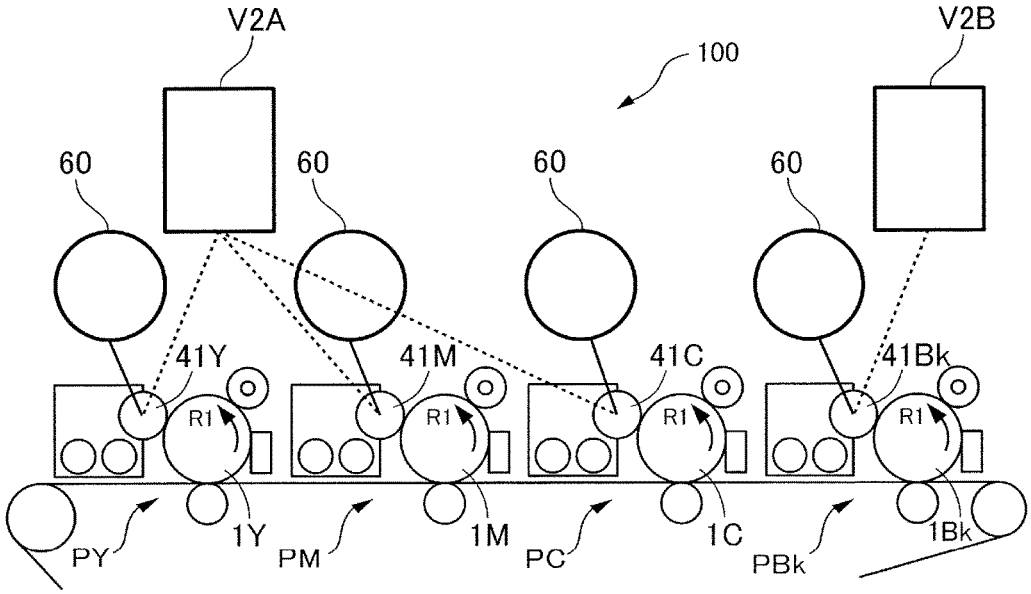
FIG. 3 schematically illustrates an image forming apparatus of a type sharing a developing power source.

The thin developer layer on the developing sleeve 41 comes into contact with the surface of the photosensitive drum 1 at the developing position c, and rubs the photosensitive drum 1 moderately. A predetermined developing voltage, i.e. a developing bias, is applied to the developer sleeve 41 by a developing power source V2 serving as a developing voltage application unit. The developing voltage applied to the developing sleeve 41 is a voltage obtained by superimposing a direct current voltage and an alternating current voltage. The direct current voltage may be referred to as Vdc or developing DC, and the alternating current voltage may be referred to as Vac or developing AC. That is, the developing power source V2 includes a direct current power source and an alternating current power source. As will be described below, in the image forming apparatus 100 of the present exemplary embodiment, the developing voltage of the same value is applied to the three developing sleeves 41 of the image forming units PY, PM, and PC at the same time by using one shared developing power source as illustrated in FIG. 3.

The toner in the developer conveyed to the developing position c by the rotating developing sleeve 41 selectively attaches to the electrostatic latent image formed on the photosensitive drum 1 by an electric field derived from the developing voltage. As a result of this, the electrostatic latent image on the photosensitive drum 1 is developed as a toner image. In the present exemplary embodiment, the toner attaches to an exposed light portion on the photosensitive drum 1 and the electrostatic latent image is reversely developed.

The developer thin layer on the developing sleeve 41 that has passed through the developing position c is subsequently conveyed back into the developer container 40 by the rotation of the developing sleeve 41. The screws 43 and 44 are provided in the developing unit 4. The screws 43 and 44 have a function of imparting the toner with a predetermined electrification charge by rotating in synchronization with the rotation of the developing sleeve 41 to agitate and mix the toner with the carrier. In addition, the screws 43 and 44 convey the developer to the opposite side from each other in the longitudinal direction to supply the developer to the developing sleeve 41.

A density sensor 45 is provided on a side wall upstream of the screw 44 of the developing unit 4. The density sensor 45 detects the toner density in the developer by detecting the change in the magnetic permeability of the developer. A toner supplying opening 47 is provided downstream of the density sensor 45 in the circulation direction of the developer. After performing the development, the developer is conveyed to a detection portion of the density sensor 45, and the toner density thereof is detected. In accordance with the results of the detection, the toner is appropriately supplied through the toner supplying opening 47 of the developing unit 4 by the rotation of a supplying screw 51 provided in a developer supplying container 5 connected to the developing unit 4 and serving as a toner supplying unit. This keeps the toner density of the developer constant.

The supplied toner is conveyed by the screw 44, and imparted with a moderate electrification charge by being mixed with the carrier. After that, the toner is conveyed to the vicinity of the developing sleeve 41 and formed into the thin layer on the developing sleeve 41 to be used for the development. In the present exemplary embodiment, a negatively-electrifiable toner having an average particle diameter of 5.5 μm is used as the toner, and a magnetic carrier having a saturated magnetization of 205 emu/cm$^3$ and an average particle diameter of 35 μm is used as the carrier. In addition, in the present exemplary embodiment, a 10:90 mixture by weight of the toner and the carrier is used as the developer.

The toner that has not been transferred onto the intermediate transfer belt 91 at the primary transfer portion d and remains on the photosensitive drum 1, i.e. transfer residue toner, is removed from the photosensitive drum 1 by the cleaning device 7. The cleaning device 7 removes the transfer residue toner from the photosensitive drum 1 by using a cleaning blade 7*a* provided so as to abut the photosensitive drum 1. The photosensitive drum 1 whose surface has been cleaned is subjected to the next image formation process. As the material for the cleaning blade 7*a*, urethane rubber-based materials are widely used.

In the present exemplary embodiment, the photosensitive drum 1, the electrification roller 2, the exposing unit 3, the developing unit 4, and the cleaning device 7 are integrally configured as a process cartridge that is attachable to and detachable from the apparatus body.

As illustrated in FIG. 3, the image forming apparatus 100 includes developing power sources V2A and V2B as a developing voltage application unit. The developing power source V2A applies a developing voltage to three developing sleeves 41Y to 41C serving as the first to third developer bearing members of the image forming units PY to PC for yellow, magenta, and cyan illustrated in FIG. 1. The developing power source V2B applies a developing voltage only to the developing sleeve 41Bk serving as the fourth developer bearing member of the image forming unit PBk for black. The reason why the image forming apparatus 100 is configured such that only the developing sleeve 41Bk for black may be individually supplied with the developing voltage from the developing power source V2B unlike the other developing sleeves is for making it possible to drive only the image forming unit PBk for black to perform image formation using only the black toner, in other words, to perform printing in a so-called black and white mode. With this configuration, compared with an image forming apparatus including a developing power source for each color, the costs for the apparatus can be reduced because the number of developing power sources are reduced, thus the space required for installing the power sources in the apparatus body is reduced, and consequently the apparatus body is miniaturized.

The developing power sources V2A and the V2B apply an oscillating voltage to the developing sleeves 41Y to 41Bk in image formation. In the oscillating voltage, a direct current voltage of −590 V and an alternating current voltage having a peak-to-peak voltage Vpp of 1800 V and a frequency of 11 kHz are superimposed on each other. In the case where the photosensitive drums 1Y to 1Bk for respective colors are electrified to a surface potential, i.e. electrification potential, of −750 V, the Vback in image formation is 750−590=160 V.

The timings for the start and stop of the rotation of the developing sleeves 41Y to 41Bk are individually controlled by different motors 60. From a viewpoint of cutting the costs of the apparatus, the motors 60 driving the developing sleeves 41Y to 41Bk may also be a common motor. For example, a single motor 60 may be used for the developing sleeves 41Y to 41C of the image forming units PY to PC to impart a driving force simultaneously. However, for example, in the case where the single motor 60 is shared by the developing sleeves 41Y to 41C, the developing sleeves 41Y to 41C keep on rotating from the start of image formation for yellow to the end of image formation for cyan. This leads to increase in the time of unnecessary rotation. As a result, the deterioration of the toner becomes notable. To avoid this, the motors 60 are not shared between the developing sleeves 41Y to 41Bk and are provided for respective developing sleeves 41Y to 41Bk such that the motors 60 can drive the developing sleeves 41Y to 41Bk independently.

Control Unit

Figure 4:
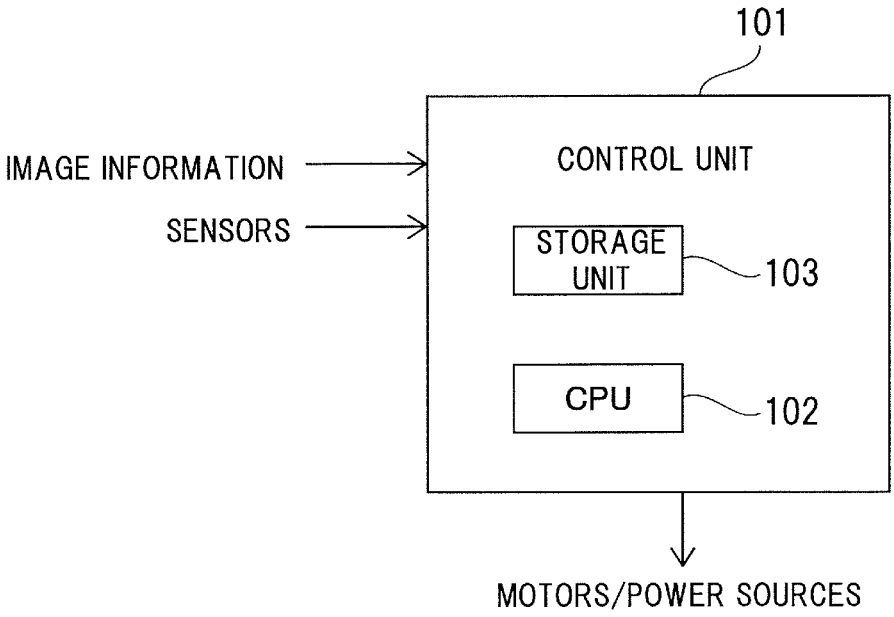
FIG. 4 is a control block diagram of the image forming apparatus.

The image forming apparatus 100 having such a configuration includes a control unit 101 that controls the image forming apparatus 100 as illustrated in FIG. 4. The control unit 101 includes a CPU 102 and a storage unit 103 and controls various motors and power sources on the basis of image information, input from various sensors, and so forth. The control unit 101 performs various control. Examples of the various controls include control for start and stop of rotation of the photosensitive drum 1, the developing sleeve 41, or the intermediate transfer belt 91, control for start and stop of application of voltage by the electrification power source V1 and the developing power sources V2A and V2B, adjustment for the value of applied voltage, start and stop of radiation by the exposing unit 3, and adjustment of the amount of radiated light. The control unit 101 is capable of performing, in executing an image formation job, control for fog-removing potential difference that will be described later.

The image formation job corresponds to a series of operations from the start to completion of image formation based on a printing signal for forming an image on a recording material. Specifically, the image formation job corresponds to a series of operations from a pre-rotation time to a post-rotation time after receiving the printing signal, and includes an image formation period and a sheet interval, that is, a period in which no image is being formed. The pre-rotation time corresponds to a preparation operation before the image formation and the post-rotation time corresponds to an operation after the image formation.

The control unit 101 is capable of simultaneously starting rotation of all the photosensitive drums 1Y, 1M, 1C, and 1Bk when starting the image formation. The control unit 101 is also capable of simultaneously stopping rotation of all the photosensitive drums 1Y, 1M, 1C, and 1Bk when completing the image formation.

In the case of an image forming apparatus of a type sharing the developing power source, control of developing voltage for any one of the image forming units by the developing power source V2A affects the other image forming units. Therefore, conventionally, the toner is likely to attach to the developing sleeve at the end of the image formation, i.e. at the time of the post-rotation, at the start of the image formation, i.e. at the time of the pre-rotation, and at both of these at the image forming unit PY for yellow, the image forming unit PC for cyan, and the image forming unit PM for magenta, respectively. In other words, the toner is likely to attach to the developing sleeve at the image forming units PY and PM that are not the most downstream in the movement direction of the intermediate transfer belt 91 at the end of the image formation, and is likely to attach to the developing sleeve 41 at the image forming units PM and PC that are not the most upstream in the movement direction of the intermediate transfer belt 91 at the start of the image formation. This is because a Vback of the same value as in the image formation is applied to the stopped developing sleeve at the start and the end of the image formation.

Attachment of Toner to Developing Sleeve

Figure 5A:
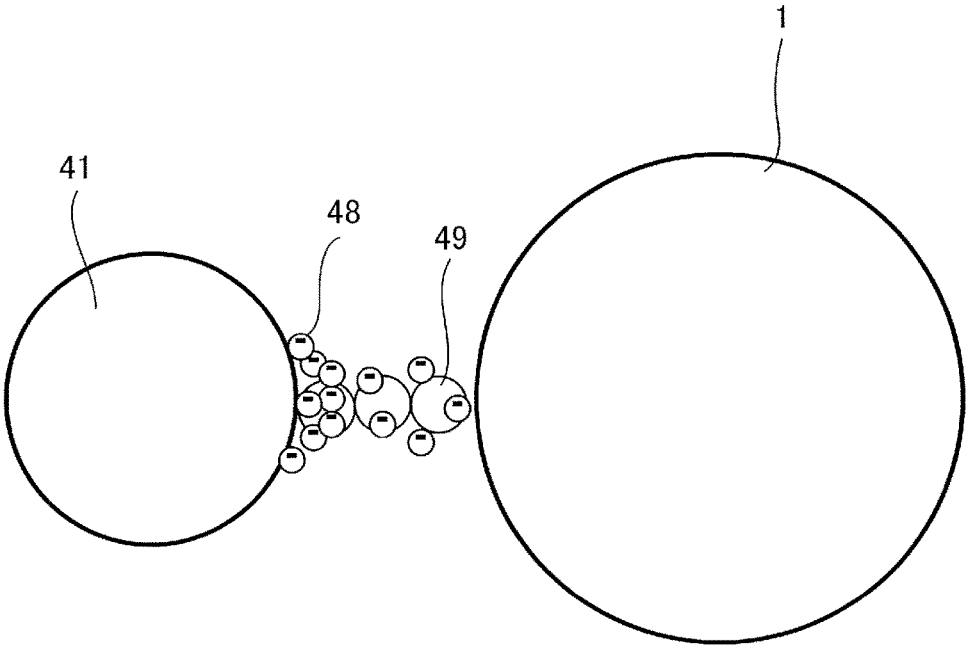
FIG. 5A schematically illustrates a state of toner in the case where a developing sleeve is stopped and Vback is large.

The state of toner in the case where the developing sleeve 41 is stopped and the Vback is large is illustrated in FIG. 5A. The attachment of toner to the developing sleeve occurs due to a potential difference, i.e. Vback, between the developing potential of the developing sleeve 41 and the surface potential of the photosensitive drum 1 when the developing sleeve 41 is stopped, and the state of occurrence of the attachment varies greatly depending on the value of Vback and the charge amount of toner at that time. When an electric field that attracts toner 48 to the developing sleeve 41, that is, Vback, is present, a phenomenon that the toner 48 attaches to the developing sleeve 41 is likely to occur. In this case, the larger Vback is, the more the toner 48 is likely to be separated from the surface of carrier 49 and move toward the developing sleeve 41 because an electric force that attracts the toner 48 to the developing sleeve 41 becomes stronger than an electrostatic force that attracts the toner 48 and the carrier 49 to each other. In addition, in the case where the charge amount of the toner 48 is large, the amount of toner 48 moving toward the developing sleeve 41 increases because the toner 48 becomes more likely to be separated from the surface of the carrier 49 by an electric field when the charge amount of the toner 48 is larger. That is, the attachment of toner to the developing sleeve 41 is likely to occur in a state where the charge amount of toner is large, and is not likely to occur in a state where the charge amount of toner is small.

Figure 13:
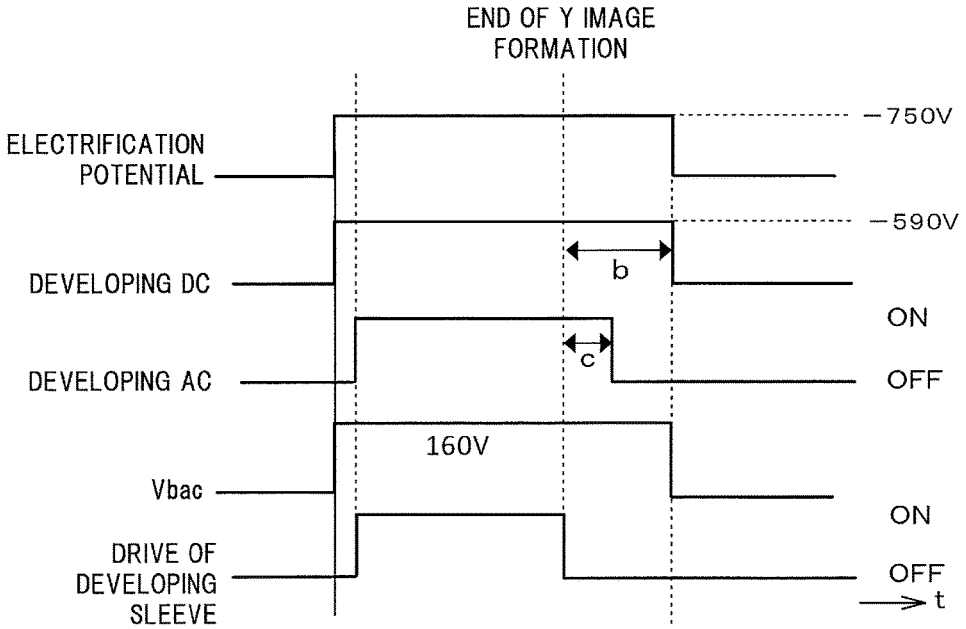
FIG. 13 is a timing chart illustrating post-rotation control for yellow of a conventional example that shares a common developing power source.

With regard to a conventional image forming apparatus, the attachment of toner to the developing sleeve in the image forming unit PY for yellow will be described with reference to FIG. 13. In FIG. 13, the electrification potential of the photosensitive drum 1 at the developing position c illustrated in FIG. 2, the developing DC, the developing AC, Vback, and drive for the rotation of the developing sleeve 41 are illustrated in this order from top to bottom. As illustrated in FIG. 13, in image formation, the surface potential, i.e. the electrification potential, of the photosensitive drum 1 is −750 V, and the developing voltage of −590 V is applied to the developing sleeve 41. That is, the Vback in image formation is 160 V.

In an image forming apparatus of a type sharing a developing power source, the state in which the developing voltage is applied is kept in a section b as illustrated in FIG. 13 because there is a case where the image formation by the other image forming units PM and PC is not completed even when the image formation by the image forming unit PY has been completed. In this case, the developing sleeve 41 is stopped when Vback at the time of image formation, i.e. Vback of 160 V, is present in the image forming unit PY. In this case, as has been already described, the Vback is applied only to a portion of the developing sleeve 41 opposing the photosensitive drum 1 as illustrated in FIG. 5A, and the toner attaches to the surface of the developing sleeve 41 in a line shape. In this way, in the case where the developing sleeve 41 in the image forming unit PY is stopped at the end of the image formation, the Vback of the same value as in the image formation is applied to the image forming unit PY because the electrification potential of the same value as in the image formation is still applied to the photosensitive drum 1 and the developing voltage of the same value as in the image formation is still applied to the developing sleeve 41. Therefore, the attachment of toner to the surface of the developing sleeve 41 opposing the photosensitive drum 1 is likely to occur. The toner is especially likely to attach to the developing sleeve 41 in a section during which the developing AC is applied, i.e. a section c in FIG. 13.

In addition, although it has been omitted in illustration, in the image forming apparatus of the type sharing the developing power source, at the start of image formation by the image forming unit PC, the developing voltage has been already applied by the developing power source V2A along with the image formation by the other image forming units PY and PM, and the electrification potential rises approximately at the same time as the application of the developing voltage. However, at this time, the developing sleeve 41 of the developing unit PC remains stopped. That is, the developing sleeve 41 is stopped while the Vback at the time of image formation is present. Thus, the attachment of toner to the surface of the developing sleeve 41 opposing the photosensitive drum 1 is likely to occur.

Figure 5B:
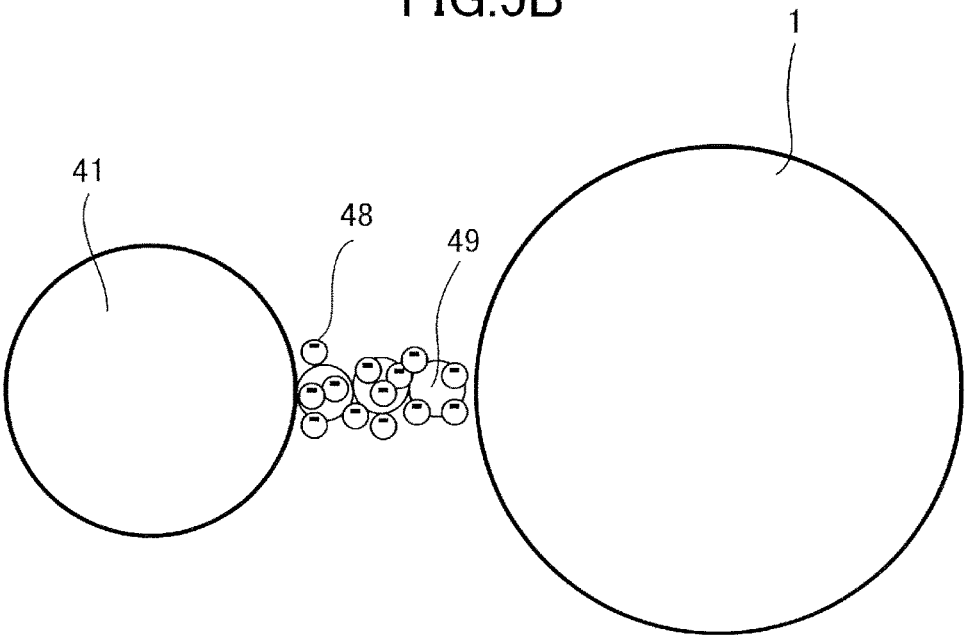
FIG. 5B schematically illustrates a state of toner in the case where the developing sleeve is stopped and the Vback is small.

In the present exemplary embodiment, considering what has been described above, with regard to an image forming unit in which the developing sleeve 41 is stopped at the start and the end of the image formation, control of setting the Vback to a potential difference smaller than the Vback at the time of image formation, i.e. control for fog-removing potential difference, is performed. According to this, as illustrated in FIG. 5B, a state where the toner 48 is attached to the carrier 49 is kept, and thus the toner 48 is unlikely to attach to the developing sleeve 41. That is, the attachment of toner to the developing sleeve 41 can be reduced.

The control for fog-removing potential difference according to the present exemplary embodiment will be described with reference to FIGS. 6 to 10. As has been described above, in the present exemplary embodiment, the timing at which the attachment of toner may occur vary between the image forming units PY, PM, and PC. Therefore, the description will be made for each of the image forming units PY, PM, and PC separately. In the control for fog-removing potential difference according to the present exemplary embodiment is performed at the time of pre-rotation or post-rotation in the image formation job. In the present exemplary embodiment, the rotation of the developing sleeve 41 is started at the start of the image formation and stopped at the end of the image formation in order from the image forming unit PY that is the most upstream in the movement direction of the intermediate transfer belt 91.

Control for Fog-Removing Potential Difference of Yellow

Figure 6:
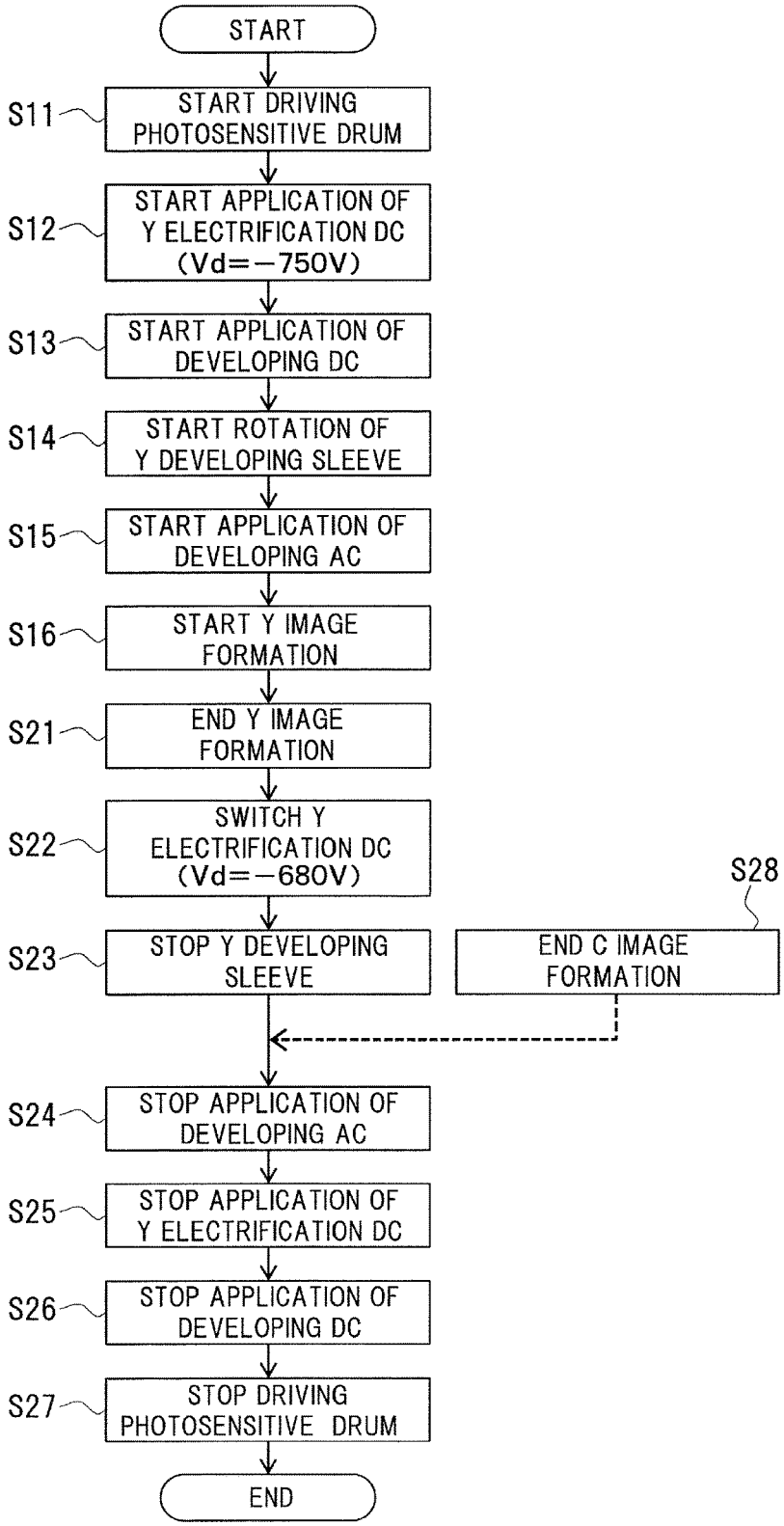
FIG. 6 is a flowchart of image formation job processing for yellow illustrating control for fog-removing potential difference.

First, the control (mode) for fog-removing potential difference of the image forming unit PY for yellow will be described using FIGS. 6 and 7 with reference to FIGS. 2 and 3. As illustrated in FIG. 6, in step S11, the control unit 101 illustrated in FIG. 1 controls a motor and so forth that are not illustrated to start the rotation of the photosensitive drum 1Y. At this time, in step S12, the control unit 101 controls the electrification power source V1 to start the application of the electrification voltage such that the electrification potential of the photosensitive drum 1Y is set to, for example, −750V. In step S13, the control unit 101 controls the developing power source V2A to start the application of the developing DC of −590 V. In addition, in step S14, the control unit 101 controls the motor 60 at a timing matching the start of the application of the developing DC to start the rotation of the developing sleeve 41Y. In step S15, the control unit 101 controls the developing power source V2A to start the application of the developing AC. According to this, Vback at the time of image formation is set to 750−590=160 V. After that, in step S16, the control unit 101 starts image formation for yellow on the basis of image information. As has been already described, in the case where the application of the developing DC and the developing AC has been started in the image forming unit PY in accordance with the control of the developing power source V2A, the application of the developing DC and the developing AC is also started in the image forming units PM and PC.

In the case where the image formation for yellow has been completed in step S21, the control unit 101 performs the following control for post-rotation. In step S22, the control unit 101 controls the electrification power source V1 to switch the electrification voltage to a voltage lower than in the image formation in an absolute value to change the electrification potential of the photosensitive drum 1Y from −750 V in the image formation to, for example, −660 V. Approximately at the same time as this, in step S23, the control unit 101 stops the developing sleeve 41. Since the image forming unit PY shares the developing power source V2A with the image forming unit PC, as a result of the application of the developing DC being stopped by the control unit 101 in the image forming unit PC in step S28, the application of the developing AC and the developing DC is also stopped in the image forming unit PY in steps S24 and S26. At this time, in step S25, the control unit 101 controls the electrification power source V1 to stop the application of the electrification voltage. Then, in step S27, the control unit 101 controls the motor and so forth that are not illustrated to stop the photosensitive drum 1Y.

Figure 7:
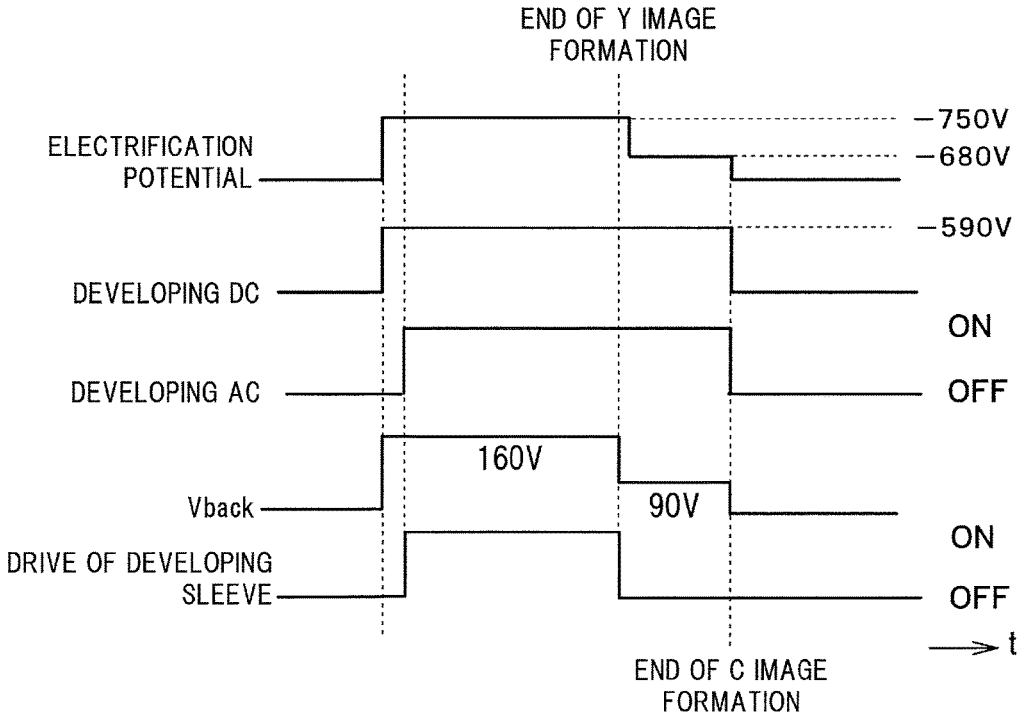
FIG. 7 is a timing chart of post-rotation control for yellow.

As illustrated in FIG. 7, in the control for fog-removing potential difference of the image forming unit PY described above, the rotation of the developing sleeve 41 is stopped at the end of the image formation, i.e. in post-rotation, for yellow. The electrification potential of the photosensitive drum 1Y at the developing position c illustrated in FIG. 2 is changed from −750 V in the image formation to −680 V approximately at the same time as the stopping, i.e. OFF timing, of the rotation of the developing sleeve 41. Along with the decrease in the electrification potential of the photosensitive drum 1Y, the Vback also decreases from 160 V in the image formation to 680−590=90 V. In this way, a state in which a Vback lower than in the image formation is applied is kept at the image forming unit PY from the stopping of the developing sleeve 41 to the stopping of the application of the developing DC. According to this, the attachment of toner to the developing sleeve 41 may be suppressed even in the case where the image formation by the other image forming units PM and PC is not completed and the developing voltage is applied to the image forming unit PY even after the developing sleeve 41 has been stopped.

As described above, in the case where the electrification power source V1 is controlled to change the Vback, the timing at which the electrification power source V1 is controlled is earlier than the timing of stopping of the rotation of the developing sleeve 41 by a time taken for the electrification position a to reach the developing position c. Specifically, for example, in the case where the distance from the electrification position a to the developing position c illustrated in FIG. 2 is 48 mm and the rotation speed of the photosensitive drum 1 is 240 mm/sec, the time taken for the electrification position a to reach the developing position c is 200 msec. In this case, the electrification voltage is lowered earlier than the stopping of the rotation of the developing sleeve 41 by 200 msec to change the electrification potential of the photosensitive drum 1 at the developing position c from −750V to −680V approximately at the same time as the stopping of the rotation of the developing sleeve 41.

Control for Fog-Removing Potential Difference of Cyan

Figure 8:
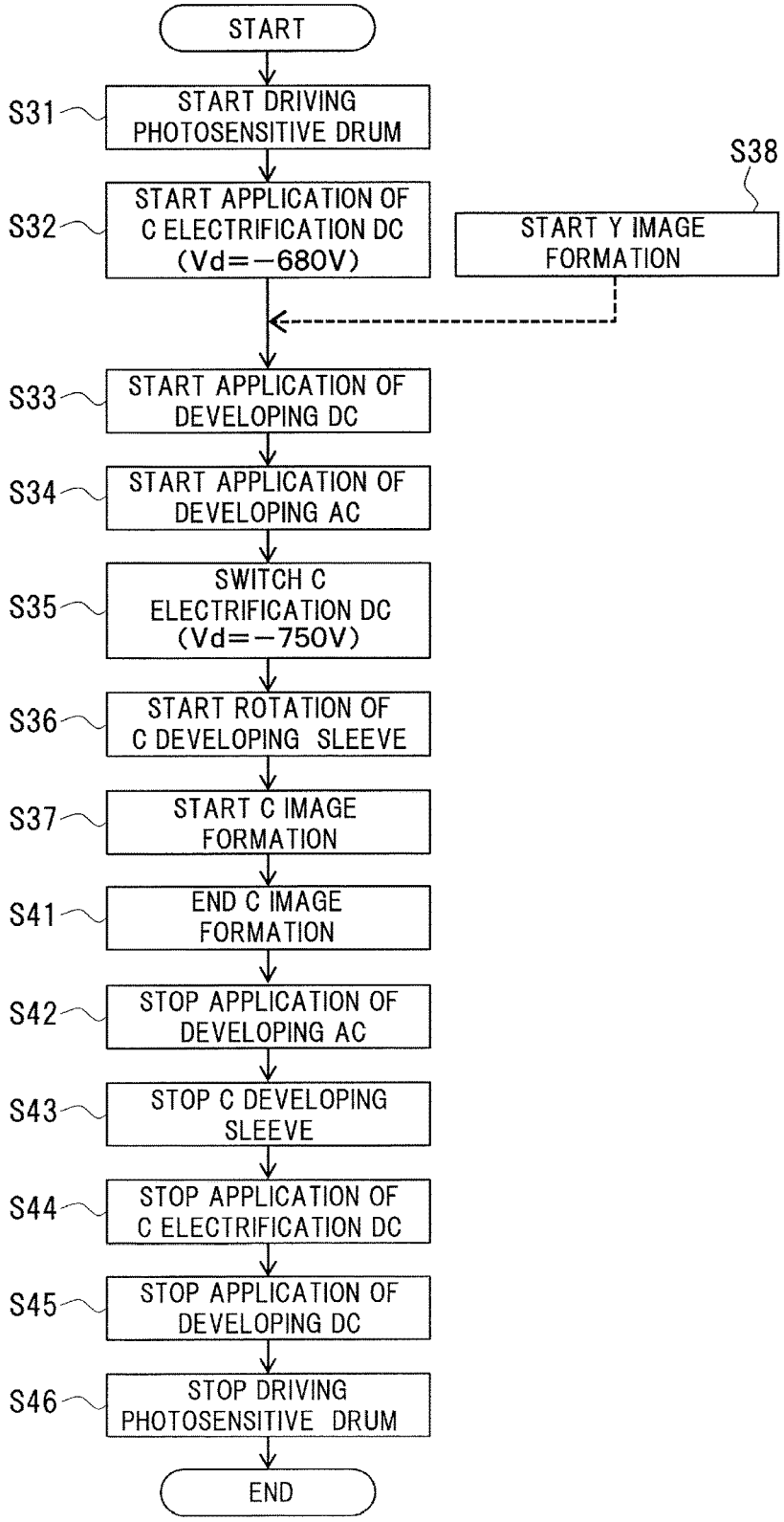
FIG. 8 is a flowchart of image formation job processing for cyan illustrating control for fog-removing potential difference.

Next, the control (mode) for fog-removing potential difference of the image forming unit PC for cyan will be described using FIGS. 8 and 9 with reference to FIGS. 2 and 3. The control unit 101 illustrated in FIG. 1 performs the following control for pre-rotation. As illustrated in FIG. 8, in step S31, the control unit 101 controls a motor and so forth that are not illustrated to start the rotation of the photosensitive drum 1C. In step S32, the control unit 101 controls the electrification power source V1 to start the application of the electrification voltage such that the electrification potential of the photosensitive drum 1C is set not to −750 V but to −680 V. Since the image forming unit PC shares the developing power source V2A with the image forming unit PY, as a result of the application of the developing DC being started by the control unit 101 in the image forming unit PY in step S38, the application of the developing AC and the developing DC is also started in the image forming unit PC in steps S33 and S34. After the image formation is started at the image forming unit PY in step S16 in FIG. 6, in step S35, the control unit 101 controls the electrification power source V1 to switch the electrification voltage to a higher voltage in an absolute value to change the electrification potential of the photosensitive drum 1C from −680 V to −750 V, which is a value in the image formation. Then, in step S36, the control unit 101 controls the motor 60 to start the rotation of the developing sleeve 41. After that, in step S37, the control unit 101 starts the image formation for cyan on the basis of image information.

In the case where the image formation for cyan has been completed in step S41, the control unit 101 performs the following control for post-rotation. In step S42, the control unit 101 controls the developing power source V2A to stop the application of the developing AC. Approximately at the same time as this, in step S43, the control unit 101 controls the motor 60 to stop the developing sleeve 41, and in step S44, controls the electrification power source V1 to stop the application of the electrification voltage. In step S45, the control unit 101 controls the developing power source V2A to stop the application of the developing DC. Then, in step S46 the control unit 101 controls the motor and so forth that are not illustrated to stop the photosensitive drum 1C. As has been already described, in the case where the application of the developing DC and the developing AC is stopped in accordance with the control of the developing power source V2A at the image forming unit PC, the application of the developing DC and the developing AC is also stopped at the image forming units PY and PM.

Figure 9:
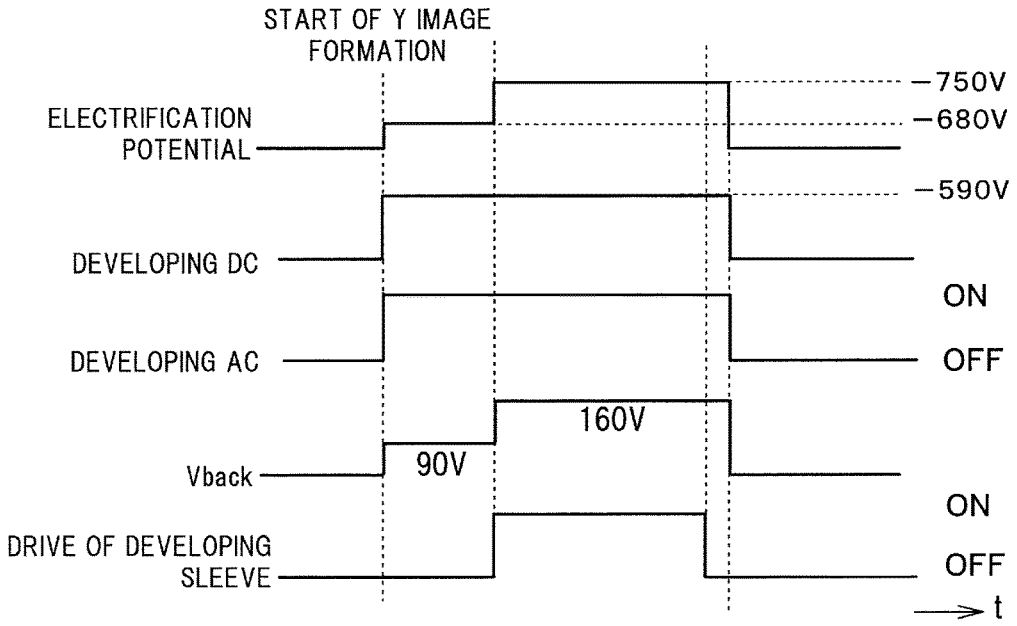
FIG. 9 is a timing chart of pre-rotation control for cyan.

As illustrated in FIG. 9, in the control for fog-removing potential difference of the image forming unit PC described above, the electrification potential of the photosensitive drum 1C at the developing position c illustrated in FIG. 2 is set to be −680 V, which is lower than −750 V in the image formation, at the start of the image formation for cyan, i.e. in pre-rotation. Meanwhile, the developing DC of −590 V has been already applied at the start of the application of the developing DC for the image forming unit PY. In addition, the electrification potential of the photosensitive drum 1C is changed from −680 V to −750 V approximately at the same time as the start, i.e. ON timing, of rotation of the developing sleeve 41. That is, a state where the Vback is lowered to 680−590=90 V, which is lower than 160 V, which is a value in the image formation, is kept from the start of the application of the developing DC to the start of rotation of the developing sleeve 41, i.e. while the developing sleeve 41 is stopped. According to this, the attachment of toner to the developing sleeve 41 is suppressed even in the case where the developing voltage is applied before the start of the image formation by the image forming unit PC along with the start of the image formation by the other image forming units PY and PM.

Control for Fog-Removing Potential Difference of Magenta

Figure 10:
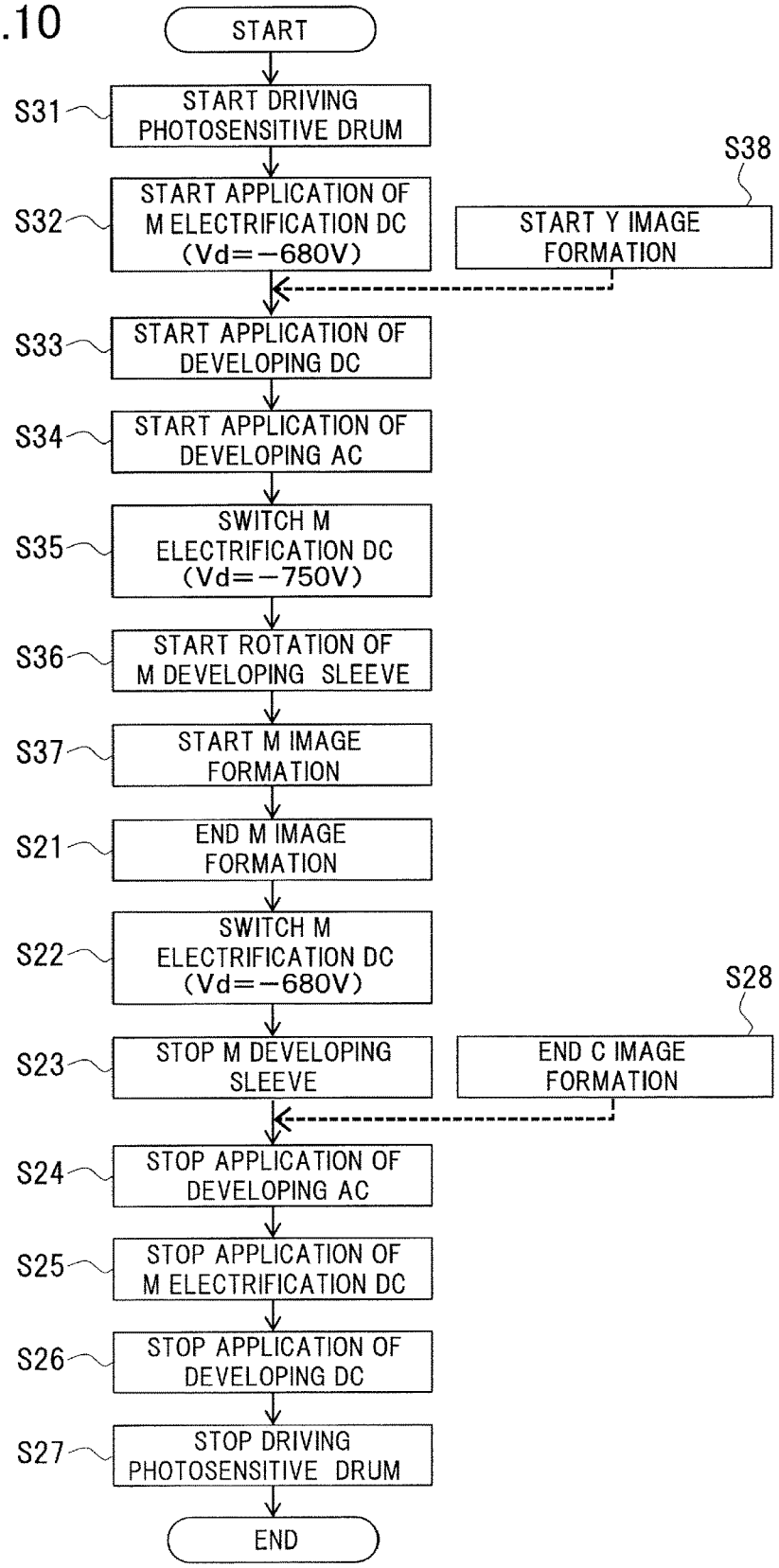
FIG. 10 is a flow chart of image formation job processing for magenta illustrating control for fog-removing potential difference.

Next, the control (mode) for fog-removing potential difference of the image forming unit PM for magenta will be described using FIG. 10. The control for pre-rotation in the control for fog-removing potential difference of the image forming unit PC described above, i.e. steps S31 to S38 in FIG. 8, and the control for post-rotation in the control for fog-removing potential difference of the image forming unit PY described above, i.e. steps S21 to S28 in FIG. 6, are applied for the control for fog-removing potential difference of the image forming unit PM. This is because the application of the developing voltage is started at the start of the image formation for yellow before the start of the image formation for magenta as in the case of cyan, and the application of the developing voltage is stopped at the end of the image formation for cyan after the end of the image formation for magenta as in the case of yellow. Therefore, in the case of the image forming unit PM, a state where a Vback lower than in the image formation is applied is taken while the developing sleeve 41 is stopped before the start of the image formation of magenta. In addition, at the end of the image formation of magenta, a state where a Vback lower than in the image formation is applied is taken from the stopping of the developing sleeve 41 until a predetermined time elapses at the end of the image formation. This suppresses the attachment of toner to the developing sleeve 41.

For the image forming unit PBk for black that does not share the developing power source, conventional control for the pre-rotation and the post-rotation may be performed.

As has been described above, according to the image forming apparatus 100 of the present exemplary embodiment, the attachment of toner to the developing sleeve 41 may be reduced by performing the control for fog-removing potential difference described above at the start and end of the image formation, i.e. in the pre-rotation and the post-rotation. That is, a state in which the Vback is lower than in the image formation is kept, at the image forming unit in which the developing sleeve 41 is stopped, by controlling the electrification potential to set the fog-removing potential difference, i.e. Vback, to be lower than in the image formation. According to this, the attachment of toner to the developing sleeve 41 may be reduced, and the image defect derived from the attachment of toner to the developing sleeve 41 may be thereby suppressed. In addition, the image defect derived from the deterioration of toner may be suppressed because the developing sleeve 41 is not rotated unnecessarily.

The inventors of the present invention investigated the occurrence of the stripe image and toner fog on the recording material when the image formation was performed while changing the magnitude of Vback. The results are shown in Table 1. In Table 1, A indicates an excellent result and C indicates a bad result. In addition, with regard to the toner fog, B indicates a result that is not as good as excellent but is relatively good.

TABLE 1

| Vback | 150 V | 140 V | 130 V | 120 V | 110 V | 100 V | 90 V | 80 V | 70 V |
|---|---|---|---|---|---|---|---|---|---|
| Stripe Image | C | C | C | C | C | A | A | A | A |
| Toner Fog | A | A | A | A | A | B | B | B | C |

As can be understood from Table 1, in the case where the Vback is equal to or lower than 100 V, the occurrence of stripe image can be suppressed even without performing the control for fog-removing potential difference described above while no image is being formed. However, in the case where the image formation is performed while the Vback is equal to or lower than 100 V, the toner fog becomes notable, that is, the amount of toner fog increases. Since the occurrence of stripe image while no image is being formed has a smaller influence than the occurrence of toner fog in the image formation, it is general to set the Vback to be 160 V, which is less likely to cause toner fog, in the image formation. In this case, as has been already described, the attachment of toner that causes the stripe image is likely to occur when the developing sleeve 41 is stopped while no image is being formed.

Therefore, in the present exemplary embodiment, the Vback is lowered, i.e. switched, to a potential that can suppress the occurrence of stripe image by performing the control for fog-removing potential difference described above. However, if the Vback is lowered to 70 V or lower, the attachment of toner to a portion of the intermediate transfer belt 91 that the toner should not attach originally will become notable, and along with this, the secondary transfer roller 10 will become dirtier. To avoid this, the Vback in the control for fog-removing potential difference is preferably set to be from 100 V to 80 V, and more preferably set to be about 90 V.

As has been already described, the attachment of toner to the developing sleeve is likely to occur in the case where the charge amount of toner is large, and it is known that the charge amount of toner changes in accordance with the relative humidity or the absolute water amount of the environment. The charge amount of toner increases when the humidity of the environment in which the image forming apparatus is used is lower, and the charge amount of toner decreases when the humidity of the environment is higher. This is because the charge of toner is more likely to be discharged in an environment with a higher humidity. In addition, the charge of toner may change in accordance with the used state of the developer. That is, the developer of a two-component developing system is constituted by toner and carrier, and the toner and the carrier is imparted with charges due to friction electrification. In this case, the charge amount of the toner remains large until a predetermined number of images, for example 50,000 or more, are formed after the initial state of the developer, that is, after the start of using the developer in the developing unit. However, if the developer is used repetitively, the external additives of the toner or the toner with a small particle diameter will be likely to attach to the surface of the carrier. If the developer continues to go through the use and the surface of the carrier is covered by these, the charge amount of toner will gradually decrease because the performance of the carrier of imparting electric charge to the toner decreases. Accordingly, the charge amount of toner is large in the case where the developer is in a low-humidity environment and in an initial state, and the charge amount of toner is small in the case where the developer is in a high-humidity environment and in a repetitively used state. Thus, the attachment of toner to the developing sleeve 41 described above is likely to occur in the case where the developer is in a low-humidity environment and in an initial state, and is unlikely to occur in the case where the developer is in a high-humidity environment and in a repetitively used state.

Meanwhile, the amount of toner fog, which is more likely to occur when the fog-removing potential difference is smaller, is more likely to be smaller when the charge amount of toner is larger and is more likely to be larger when the charge amount of toner is smaller. That is, by contrast with the attachment of toner to the developing sleeve 41, the amount of toner fog is likely to be smaller in the case where the developer is in a low-humidity environment and in an initial state, and is likely to be larger in the case where the developer is in a high-humidity environment and in a repetitively used state. The points described above are summarized in Table 2.

TABLE 2

| | Amount of toner attached in line shape | Amount of toner fog |
|---|---|---|
| Low-humidity environment/ Initial state | Large | Small |
| High-humidity environment/ Repetitively used state | Small | Large |

In the control for fog-removing potential difference described above illustrated in FIGS. 6, 8, and 10, the Vback is lowered to the same value, for example, 90V, regardless of the charge amount of toner. However, it is preferable to change the magnitude of Vback in the control for fog-removing potential difference in accordance with information about the charge amount of toner, that is, the humidity or the water amount of the environment and the state of the developer. That is, the control for the Vback in the control for fog-removing potential difference is not limited to lowering the Vback to a constant value. For example, the Vback may be controlled to be the value, i.e. potential difference, illustrated in Table 3 below. Thus, as illustrated in FIG. 1, a temperature/humidity detection sensor 50 serving as a humidity detection unit is provided in the apparatus body of the image forming apparatus 100, and the temperature/humidity sensor 50 is configured to detect the temperature and the humidity in the vicinity of the image forming units. In addition, as illustrated in FIG. 4, the storage unit 103 that stores the accumulated number of sheets of the recording material S on which images have been formed is provided. The temperature/humidity sensor 50 and the storage unit 103 function as a charge amount detection unit that detects information about the charge amount of toner. The control unit 101 sets the Vback in accordance with the humidity detected by the temperature/humidity sensor 50 and the number of sheets used for printing, stored in the storage unit 103 in a manner shown in Table 3.

TABLE 3

| | Relative humidity (%) | | |
|---|---|---|---|
| Number of sheets used for printing | 0~15 | 16~70 | 71~100 |
| 0~10000 | 80 V | 80 V | 90 V |
| 10001~20000 | 80 V | 90 V | 90 V |
| 20001~30000 | 80 V | 90 V | 100 V |
| 30001~40000 | 90 V | 100 V | 110 V |

TABLE 3-continued

| Number of sheets used for printing | Relative humidity (%) 0~15 | 16~70 | 71~100 |
|---|---|---|---|
| 40001~50000 | 90 V | 100 V | 120 V |
| 50001~ | 90 V | 110 V | 140 V |

For example, in the case where the relative humidity is 15% or lower and the number of used sheets is 10,000 or less, i.e. in the case where the charge amount of toner is large, the Vback in the control for fog-removing potential difference is set to 80 V as shown in Table 3. In this case, the Vback is set to 670−590=80 V, which is lower than 160 V in the image formation, by changing the electrification potential from −750 V to −670 V. By lowering the Vback to 80 V in the control for fog-removing potential difference, the attachment of toner may be reduced even in the case where the charge amount of toner is large.

For example, in the case where the relative humidity is 71% or higher and the number of used sheets is 50,001 or more, i.e. in the case where the charge amount of toner is small, the Vback in the control for fog-removing potential difference is set to 140 V as shown in Table 3. In this case, the Vback is set to 730−590=140 V, which is lower than 160 V in the image formation, by changing the electrification potential from −750 V to −730 V. By lowering the Vback to 140 V in the control for fog-removing potential difference, the attachment of toner may be reduced enough in the case where the charge amount of toner is small. However, for example, if the Vback is lowered to a value lower than 140 V in this case, the amount of toner attached to the intermediate transfer belt 91 will increase, and the secondary transfer roller 10 will be dirtier. To avoid this, the Vback in the control for fog-removing potential difference is set to 140 V herein.

As described above, the Vback in the control for fog-removing potential difference may be set to an appropriate value in accordance with the environment in which the image forming apparatus is used and the used state of the developer. According to this, the attachment of toner to the developing sleeve may be suppressed in any environment.

In addition, it is preferable not to perform the control for fog-removing potential difference described above in the case where the information about the charge amount of toner indicates a value smaller than a value corresponding to a predetermined charge amount, and to perform the control for fog-removing potential difference described above in the case where the information about the charge amount of toner indicates a value equal to or greater than the value corresponding to the predetermined charge amount. According to this, the attachment of toner to the developing sleeve 41 may be efficiently suppressed in the use of the apparatus.

Figure 14:
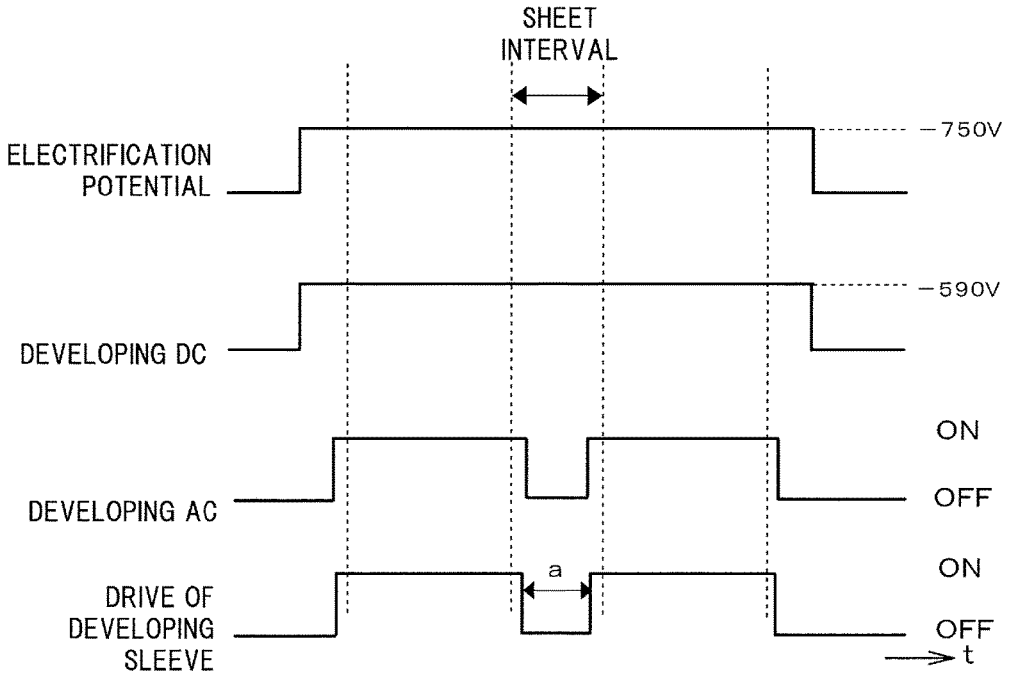
FIG. 14 is a timing chart illustrating electrification potential and developing voltage of the conventional example in the case where a developing sleeve is stopped when image formation is not performed during a consecutive image formation job.

Meanwhile, it is also preferable for the image forming apparatus 100 described above to stop the developing sleeve 41 for as long a time as possible in the sheet interval in order to suppress the deterioration of the toner. Especially, in the case where the sheet interval is relatively long, for example, when the conveyance of the sheet is waited for in a double-sided printing or the adjustment of temperature of the fixing unit is waited for, it is preferable to stop the developing sleeve 41 because the time of unnecessary rotation of the developing sleeve 41 becomes longer and thus the deterioration of toner becomes likely to occur in this case. In addition, in the case where the sheet interval is relatively long, there is a temporal room to stop the developing sleeve 41. However, conventionally, the attachment of toner to the developing sleeve 41 occurs in the case where the developing sleeve 41 is stopped in the sheet interval. This point will be described with reference to FIG. 14. FIG. 14 illustrates the electrification potential and the developing voltage according to a conventional example in the case where the developing sleeve 41 is stopped throughout a section a while an image is not formed in the image forming job, that is, in the sheet interval.

As illustrated in FIG. 14, for example, in the case where the surface potential, i.e. electrification potential, of the photosensitive drum 1 is −750 V and a developing voltage of −590 V is applied to the developing sleeve 41, the toner is attracted to the surface of the developing sleeve 41 due to a Vback of 160 V. This causes the attachment of toner to the developing sleeve 41. That is, in the case where the developing sleeve 41 is stopped while no image is being formed in the image formation job, a Vback of the same value as in the image formation is applied because the electrification voltage of the same value as in the image formation is still applied to the photosensitive drum 1 and the developing voltage of the same value as in the image formation is still applied to the developing sleeve 41. Therefore, the toner is likely to attach to the surface of the developing sleeve 41 opposing the photosensitive drum 1.

In the case where the developing sleeve 41 is rotated in the next image formation after that, the image density on a portion of the photosensitive drum 1 opposing a portion of the surface of the developing sleeve 41 to which the toner is attached is increased compared with the other portions because the electric field between the developing sleeve 41 and the photosensitive drum 1 changes at the portion due to the electric charge of the attached toner. For example, in the case where the potential of a light exposed portion of the photosensitive drum 1 is −390 V and the developing voltage of −590 V is applied to the developing sleeve 41, the electrostatic latent image is developed, with a toner negatively electrified, by the potential difference of 200 V. However, since the potential difference becomes a little higher than 200 V, in the portion of the developing sleeve 41 to which the toner has been attached, due to the electric charge of the toner, the image density is increased only in a region corresponding to the portion.

Considering what has been described above, in the present exemplary embodiment, it is preferable to perform control to set the Vback for the stopped developing sleeve to a potential difference lower than the Vback in the image formation, i.e. to perform the control for fog-removing potential difference, in the case where the developing sleeve 41 is stopped while no image is being formed in a consecutive image formation job, i.e. in the sheet interval. According to this, the state in which the toner 48 is attached to the carrier 49 as illustrated in FIG. 5B is kept, and thus the toner 48 becomes unlikely to attach to the developing sleeve 41. That is, the attachment of toner to the developing sleeve 41 may be reduced.

Referential Example

A referential example of control (mode) for fog-removing potential difference in the sheet interval will be described using FIGS. 11 and 12 with reference to FIG. 2. In the present exemplary embodiment, the Vback for the stopped developing sleeve is set to a potential difference lower than in the image formation by switching the electrification voltage in accordance with the stopping of the developing sleeve 41 in the sheet interval in the image formation job.

Figure 11:
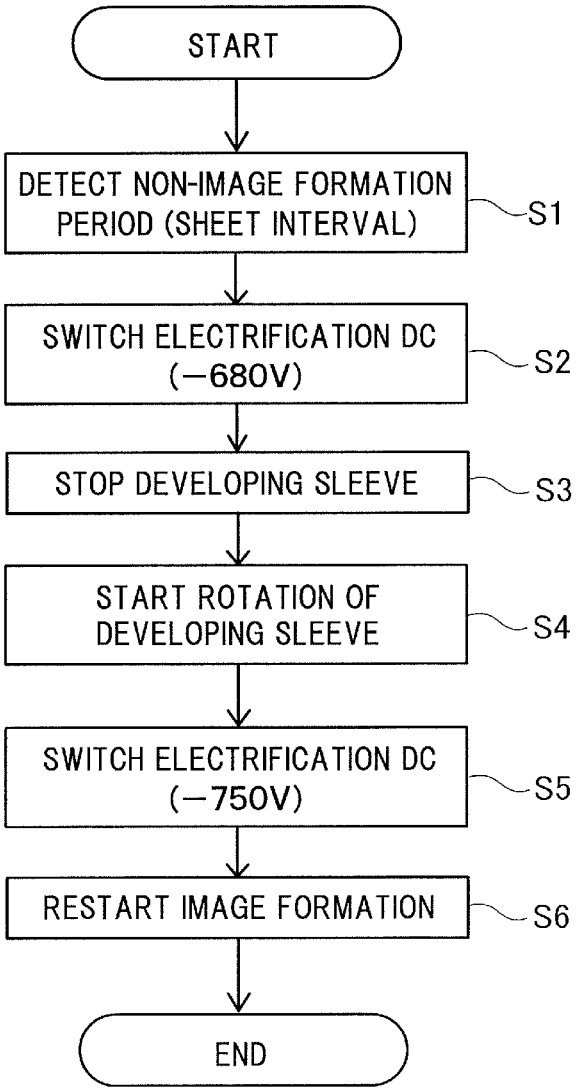
FIG. 11 is a flowchart of control for fog-removing potential difference of a referential example.

The control for fog-removing potential difference illustrated in FIG. 11 is performed by the control unit 101 for each of the image forming units PY to PBk.

As illustrated in FIG. 11, in the case where a sheet interval longer than a predetermined time is detected in step S1 while performing a consecutive image formation job, the control unit 101 controls the electrification power source V1 to switch the electrification voltage to a voltage lower in an absolute value than in the image formation in step S2. According to this, the electrification potential of the photosensitive drum 1 is changed from −750 V in the image formation to, for example, −680 V. Approximately at the same time as this, the control unit 101 controls the motor 60 to stop the developing sleeve 41 in step S3. This state in which the electrification voltage is applied and the developing sleeve 41 is stopped is kept until the next recording material S reaches the primary transfer portion d and the sheet interval ends. In addition, the control unit 101 continues to control the developing power source V2A illustrated in FIG. 3 to keep the developing DC to the same value, for example, −590 V, as in the image formation while the developing sleeve 41 is stopped.

The sheet interval longer than the predetermined time refers to a sheet interval in which the period from the time at which the last recording material S has passed through the primary transfer portion d illustrated in FIG. 2 to the time at which the next recording material S reaches the primary transfer portion d is relatively long. Specifically, the sheet interval longer than the predetermined time corresponds to the waiting time for the conveyance of sheet in a double-sided printing or the waiting time for the adjustment of the temperature of the fixing unit.

In step S4, the control unit 101 controls the motor 60 to restart the rotation of the developing sleeve 41 at the end of the sheet interval. Approximately at the same time as this, in step S5, the control unit 101 controls the electrification power source V1 to switch the electrification voltage to the voltage of a value in the image formation. According to this, the electrification potential of the photosensitive drum 1 is changed back to −750 V from, for example, −680V. After that, in step S6, the control unit 101 restarts the image formation.

Figure 12:
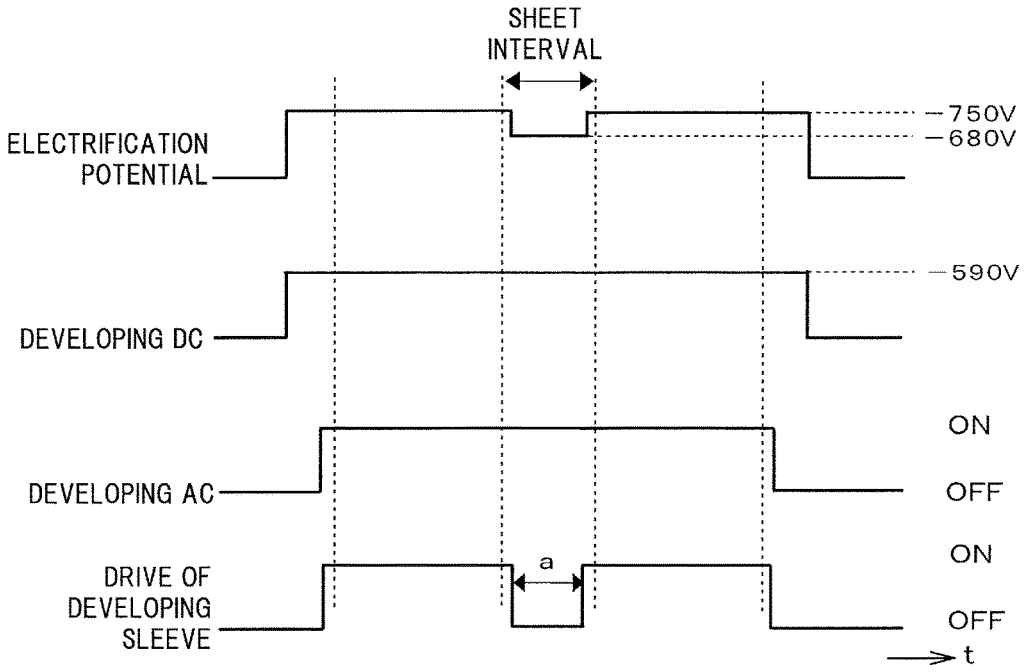
FIG. 12 is a timing chart illustrating the control for fog-removing potential difference of the referential example.

FIG. 12 is a timing chart illustrating the control for fog-removing potential difference described above, and shows the electrification potential of the photosensitive drum 1 at the developing position c illustrated in FIG. 2, the developing DC, the developing AC, and the rotation of the developing sleeve 41 in this order from top to bottom.

As illustrated in FIG. 12, in the control for fog-removing potential difference described above, the electrification potential is switched to −680 V, which is lower than −750 V in the image formation, in the sheet interval and approximately at the same time as the stopping, i.e. OFF timing, of the developing sleeve 41. Along with the decrease in the electrification potential, the Vback decreases to 680−590=90 V from 750−590=160 V, which is a value in the image formation. Then, when the sheet interval ends and the rotation of the developing sleeve 41 is restarted, the electrification potential is switched to −750V, which is a value in the image formation, approximately at the same time as the start, i.e. ON timing, of rotation of the developing sleeve 41. According to this, the Vback is changed back from 90 V to 160 V, which is a value in the image formation. The image formation is restarted after the Vback has been changed back to 160 V. In this way, the state in which the Vback is lower than in the image formation is kept while the developing sleeve 41 is stopped in the sheet interval. In this case, the attachment of toner to the developing sleeve 41 may be suppressed because the state in which the toner 48 is attached to the carrier 49 as illustrated in FIG. 5B may be kept.

As has been described above, by controlling the electrification voltage to set the fog-removing potential difference, i.e. Vback, to be lower than in the image formation when the developing sleeve is stopped in the sheet interval, the state in which the Vback is lower than in the image formation is kept while the developing sleeve is stopped in the sheet interval. According to this, in the case where the developing sleeve is to be stopped in the sheet interval to suppress the deterioration of toner, the attachment of toner to the developing sleeve can be reduced, and thus the image defect derived from the attachment of toner to the developing sleeve can be suppressed. In addition, the image defect derived from the deterioration of toner can be suppressed because the time of unnecessary rotation of the developing sleeve is shortened by stopping the developing sleeve 41.

Other Embodiments

In the control for fog-removing potential difference, i.e. in executing a mode, the absolute value of the surface potential of the photosensitive drum 1 may be reduced by causing the electrification power source V1 to apply an electrification voltage of a constant value, for example, −750 V, and controlling the exposing unit 3 without controlling the electrification power source V1. In this case, the exposing unit 3 illustrated in FIG. 2 functions as a charge removing unit that exposes the surface of the photosensitive drum 1, which has been electrified by the electrification voltage, to remove the charge from the surface. The potential of the exposed portion at the time of the exposure for charge removal is different from in the image formation. That is, the exposing unit 3 is capable of radiating laser light in different light amounts in the image formation and in the exposure for charge removal, and reduces the absolute value of the electrification potential to respective predetermined values of potential by exposing the surface of the photosensitive drum 1Y that has been electrified.

However, in the case where the distance from the exposing position b to the developing position c illustrated in FIG. 2 is, for example, 24 mm, and the rotation speed of the photosensitive drum 1 is 240 mm/sec, the time taken for a portion on the photosensitive drum 1 to move from the exposing position b, i.e. charge removing position, to the developing position c is 100 msec. In this case, the electrification voltage is lowered earlier than the end of the rotation of the developing sleeve 41 by 100 msec to change the electrification potential of the photosensitive drum 1 at the developing position c from −750 V to −660 V approximately at the same time as the end of the rotation of the developing sleeve 41.

Although the Vback for yellow, magenta, cyan is all lowered to the same value of 90 V in the exemplary embodiment described above, Vback of different values may be set for different colors, for example, in accordance with the humidity and the number of sheets used for printing shown in Table 3.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

This application claims the benefit of Japanese Patent Application No. 2015-240858, filed Dec. 10, 2015, which is hereby incorporated by reference herein in its entirety.

What is claimed is:

1. An image forming apparatus comprising:

a first image forming unit comprising:

a first image bearing member that is rotatably provided;

a first electrification portion configured to electrify the first image bearing member; and a first developer bearing member that is rotatably provided and disposed to face the first image bearing member, the first developer bearing member being configured to bear a developer including a first toner and a carrier so as to develop an electrostatic latent image formed on the first image bearing member;

a second image forming unit comprising:

a second image bearing member that is rotatably provided;

a second electrification portion configured to electrify the second image bearing member; and a second developer bearing member that is rotatably provided and disposed to face the second image bearing member, the second developer bearing member being configured to bear a developer including a second toner and a carrier so as to develop an electrostatic latent image formed on the second image bearing member;

a movable image transfer member to which a first toner image formed on the first image bearing member and a second toner image formed on the second image bearing member are respectively transferred, a position where the second toner image is transferred on the image transfer member is located downstream of a position where the first toner image is transferred on the image transfer member in a moving direction of the image transfer member;

a first driving portion configured to rotate the first developer bearing member;

a second driving portion configured to rotate the second developer bearing member;

a first electrification bias application portion configured to apply a first electrification bias to the first electrification portion;

a second electrification bias application portion configured to apply a second electrification bias to the second electrification portion;

a developing bias application portion configured to apply a common developing bias to both of the first developer bearing member and the second developer bearing member; and a controller configured to control the second electrification bias application portion so as to have a voltage value of the second electrification bias applied to the second electrification portion in a first period different from that in a second period such that an absolute value of a potential difference between a surface potential of the second image bearing member and the common developing bias applied to the second developer bearing member by the developing bias applying portion in the first period is smaller than that in the second period, where the first period is a period during which image formation by the first image forming unit is executed and image formation by the second image forming unit is not executed in a condition in which the first electrification bias is applied to the first electrification portion by the first electrification bias application portion, the second electrification bias is applied to the second electrification portion by the second electrification bias application portion, the common developing bias is applied to both the first developer bearing member and the second developer bearing member by the developing bias application portion, the first developer bearing member is rotated by the first driving portion, and the second developer bearing member is not rotated by the second driving portion, and the second period is a period which is subsequent to the first period, and during which image formation by the first image forming unit and image formation by the second image forming unit are executed in a condition in which the first electrification bias is applied to the first electrification portion by the first electrification bias application portion, the second electrification bias is applied to the second electrification portion by the second electrification bias application portion, the common developing bias is applied to both of the first developer bearing member and the second developer bearing member by the developing bias application portion, the first developer bearing member is rotated by the first driving portion, and the second developer bearing member is rotated by the second driving portion.

2. The image forming apparatus according to claim 1, wherein the controller controls the second electrification bias application portion in response to a start of rotation of the second developer bearing member by the second driving portion in the second period so as to have the voltage value of the second electrification bias in the first period differ from that in the second period such that the absolute value in the first period is smaller than that in the second period.

3. The image forming apparatus according to claim 1, further comprising a charge amount detection unit configured to detect information about a charge amount of the second toner, wherein the controller is configured to control the second electrification bias application portion such that the surface potential of the second image bearing member is set to a predetermined potential in a case where a value indicated by the information about the charge amount of the second toner detected by the charge amount detection unit is equal to or more than a value corresponding to a predetermined charge amount.

4. The image forming apparatus according to claim 3, wherein the charge amount detection unit comprises:

a humidity detection unit configured to detect humidity in a vicinity of the second image forming unit, wherein the controller is configured to set the potential difference in accordance with the humidity detected by the humidity detection unit and an accumulated number of recording materials on which images have been formed.

5. The image forming apparatus according to claim 1, further comprising an exposing portion configured to expose the second image bearing member that has been electrified by the second electrification portion and to form an electrostatic latent image on the second image bearing member, the exposing portion being disposed downstream of the second electrification portion and upstream of the position on which the second toner image is transferred to the image transfer member in a rotation direction of the second image bearing member, wherein the controller controls the exposing portion such that the surface potential of the second image bearing member is set to a predetermined potential.

6. The image forming apparatus according to claim 1, wherein the image transfer member is a belt that is rotatably provided, and the position where the second toner image is transferred to the belt is located downstream of the position where the first toner image is transferred to the belt and located upstream of the position where the first toner image on the belt is transferred to a recording material in a rotating direction of the belt.

7. An image forming apparatus comprising:

a first image forming unit comprising:

a first image bearing member that is rotatably provided;

a first electrification portion configured to electrify the first image bearing member; and a first developer bearing member that is rotatably provided and disposed to face the first image bearing member, the first developer bearing member being configured to bear a developer including a first toner and a carrier so as to develop an electrostatic latent image formed on the first image bearing member;

a second image forming unit comprising:

a second image bearing member that is rotatably provided;

a second electrification portion configured to electrify the second image bearing member; and a second developer bearing member that is rotatably provided and disposed to face the second image bearing member, the second developer bearing member being configured to bear a developer including a second toner and a carrier so as to develop an electrostatic latent image formed on the second image bearing member;

a movable image transfer member to which a first toner image formed on the first image bearing member and a second toner image formed on the second image bearing member are respectively transferred, a position where the second toner image is transferred on the image transfer member is located downstream of a position where the first toner image is transferred on the image transfer member in a moving direction of the image transfer member;

a first driving portion configured to rotate the first developer bearing member;

a second driving portion configured to rotate the second developer bearing member;

a first electrification bias application portion configured to apply a first electrification bias to the first electrification portion;

a second electrification bias application portion configured to apply a second electrification bias to the second electrification portion;

a developing bias application portion configured to apply a common developing bias to both of the first developer bearing member and the second developer bearing member; and a controller configured to control the first electrification bias application portion so as to have a voltage value of the first electrification bias applied to the first electrification portion in a first period different from that in a second period such that an absolute value of a potential difference between a surface potential of the first image bearing member and the common developing bias applied to the first developer bearing member by the developing bias applying portion in the second period is smaller than that in the first period, where the first period is a period during which image formation by the first image forming unit is executed and image formation by the second image forming unit is executed in a condition in which the first electrification bias is applied to the first electrification portion by the first electrification bias application portion, the second electrification bias is applied to the second electrification portion by the second electrification bias application portion, the common developing bias is applied to both the first developer bearing member and the second developer bearing member by the developing bias application portion, the first developer bearing member is rotated by the first driving portion, and the second developer bearing member is rotated by the second driving portion, and the second period is a period which is subsequent to the first period, and during which image formation by the first image forming unit is not executed and image formation by the second image forming unit is executed in a condition in which the first electrification bias is applied to the first electrification portion by the first electrification bias application portion, the second electrification bias is applied to the second electrification portion by the second electrification bias application portion, the common developing bias is applied to both of the first developer bearing member and the second developer bearing member by the developing bias application portion, the first developer bearing member is not rotated by the first driving portion, and the second developer bearing member is rotated by the second driving portion.

8. The image forming apparatus according to claim 7, further comprising a charge amount detection unit configured to detect information about a charge amount of the first toner, wherein the controller is configured to control the first electrification bias application portion such that the surface potential of the first image bearing member is set to a predetermined potential in a case where a value obtained from the information about the charge amount of the first toner detected by the charge amount detection unit is equal to or more than a value corresponding to a predetermined charge amount.

9. The image forming apparatus according to claim 8, wherein the charge amount detection unit comprises:

a humidity detection unit configured to detect humidity in a vicinity of the first image forming unit, wherein the controller is configured to set the potential difference in accordance with the humidity detected by the humidity detection unit and an accumulated number of recording materials on which images have been formed.

10. The image forming apparatus according to claim 7, further comprising an exposing portion configured to expose the first image bearing member that has been electrified by the first electrification portion and to form an electrostatic latent image on the first image bearing member, the exposing portion being disposed downstream of the first electrification portion and upstream of the position on which the first toner image is transferred to the image transfer member in a rotation direction of the second image bearing member, wherein the controller controls the exposing portion such that the surface potential of the first image bearing member is set to a predetermined potential.

11. The image forming apparatus according to claim 7, wherein the image transfer member is a belt that is rotatably provided, and the position where the second toner image is transferred to the belt is located downstream of the position where the first toner image is transferred to the belt and located upstream of the position where the first toner image on the belt is transferred to a recording material in a rotating direction of the belt.

12. The image forming apparatus according to claim 7, wherein the controller controls the first electrification bias application portion in response to a stop of rotation of the first developer bearing member by the first driving portion in the second period so as to have the voltage value of the second electrification bias in the first period differ from that in the second period such that the absolute value in the second period is smaller than that in the first period.

* * * * *